US010975896B2

(12) United States Patent
Böhm et al.

(10) Patent No.: US 10,975,896 B2
(45) Date of Patent: Apr. 13, 2021

(54) PNEUMATIC VALVE DRIVE

(71) Applicant: VAT Holding AG, Haag (CH)

(72) Inventors: Christoph Böhm, Gams (CH); Adrian Eschenmoser, Grabs (CH)

(73) Assignee: VAT Holding AG, Haag (CH)

( * ) Notice: Subject to any disclaimer, the term of this patent is extended or adjusted under 35 U.S.C. 154(b) by 0 days.

(21) Appl. No.: 15/741,595

(22) PCT Filed: Jul. 25, 2016

(86) PCT No.: PCT/EP2016/067629
§ 371 (c)(1),
(2) Date: Jan. 3, 2018

(87) PCT Pub. No.: WO2017/025302
PCT Pub. Date: Feb. 16, 2017

(65) Prior Publication Data

US 2018/0195537 A1 Jul. 12, 2018

(30) Foreign Application Priority Data

Aug. 10, 2015 (AT) ..... A 526/2015

(51) Int. Cl.
*F15B 15/28* (2006.01)
*F15B 15/20* (2006.01)
(Continued)

(52) U.S. Cl.
CPC ..... *F15B 15/2815* (2013.01); *F15B 11/046* (2013.01); *F15B 11/10* (2013.01);
(Continued)

(58) Field of Classification Search
CPC .... F16K 51/02; F15B 11/046; F15B 15/2815; F15B 15/04; F15B 15/202; F15B 11/10
See application file for complete search history.

(56) References Cited

U.S. PATENT DOCUMENTS 4,106,390 A * 8/1978 Kodaira ..... G05B 19/238 91/359
6,032,419 A 3/2000 Hurwitt
(Continued)

FOREIGN PATENT DOCUMENTS

DE 4322496 1/1995
DE 102006049491 4/2008
(Continued)

OTHER PUBLICATIONS

Servopneumatik, FESTO, 2 pages, http://www.festo.com/viki/de/Servopneumatik, Apr. 24, 2014.
(Continued)

*Primary Examiner* — Abiy Teka
(74) *Attorney, Agent, or Firm* — Volpe Koenig

(57) ABSTRACT

A pneumatic valve drive (1) for a valve (2), in particular for a vacuum valve, which has at least one pneumatic cylinder (3) with at least one piston (4) that is movably mounted in the pneumatic cylinder (3) and at least two cylinder cavities (5, 6) arranged on opposite sides of the piston (4). Each cylinder cavity (5, 6) is connected to at least one pressure source for applying pressure to each cylinder cavity (5, 6). One of the pressure sources is a constant pressure source (7) for applying a constant pressure to the cylinder cavity (5) arranged on one of the sides of the piston, and one of the other pressure sources is a regulated pressure source (8) for applying a variably regulatable pressure to the cylinder cavity (6) arranged on the opposite side of the piston (4).

9 Claims, 4 Drawing Sheets

(51) Int. Cl.
*F15B 11/046* (2006.01)
*F15B 11/10* (2006.01)
*F15B 15/04* (2006.01)

(52) U.S. Cl.
CPC ..... *F15B 15/04* (2013.01); *F15B 15/202* (2013.01); *F15B 2211/27* (2013.01); *F15B 2211/329* (2013.01); *F15B 2211/7053* (2013.01)

(56) References Cited

U.S. PATENT DOCUMENTS

| | | | | |
|---|---|---|---|---|
| 9,458,864 | B2 * | 10/2016 | Hyon | F15B 13/021 |
| 2002/0092569 | A1 | 7/2002 | Maung | |
| 2004/0122536 | A1 | 6/2004 | Saitou | |
| 2004/0182231 | A1 * | 9/2004 | Yo | F15B 9/09 91/361 |
| 2004/0245489 | A1 | 12/2004 | Kurita et al. | |
| 2007/0044465 | A1 | 3/2007 | Zhang et al. | |
| 2010/0090145 | A1 | 4/2010 | Maerk | |
| 2010/0132908 | A1 | 6/2010 | Beyer-Steinhauer et al. | |
| 2011/0175011 | A1 | 7/2011 | Ehme et al. | |
| 2013/0145926 | A1 * | 6/2013 | Koeckemann | F15B 21/087 91/363 R |

FOREIGN PATENT DOCUMENTS

| | | |
|---|---|---|
| EP | 1396642 | 3/2004 |
| EP | 1414059 | 4/2004 |
| GB | 2203195 | 10/1988 |
| JP | H03120390 | 12/1991 |
| JP | H0627060 | 4/1994 |
| JP | H0627060 U * | 4/1994 |
| JP | 2004144196 | 5/2004 |
| WO | 2004102055 | 11/2004 |

OTHER PUBLICATIONS

Servopneumatics, FESTO, 24 pages, Apr. 2014.

Renishaw apply innovationk, "Non-contact encoder products guide", 20 pages, 2012.

TR Electronic, "Linear Encoders Overview", www.tr-electronic.com, 24, pages, Mar. 2015.

Kübler, "Linear measuring technology", www.kuebler.com, 4 pages, Jun. 2015.

* cited by examiner

PNEUMATIC VALVE DRIVE

BACKGROUND

The present invention relates to a pneumatic valve drive for a valve, in particular a vacuum valve, which has at least one pneumatic cylinder having at least one piston that is mounted so as to be displaceable in the pneumatic cylinder, and having at least two cylinder cavities that are disposed at mutually opposite sides of the piston, wherein each of the cylinder cavities is connected in each case to at least one pressure source in order for the respective cylinder cavity to be impinged with pressure.

The invention furthermore also relates to a method for operating such a pneumatic valve drive and also to a valve, in particular a vacuum valve, having at least one such pneumatic valve drive.

Pneumatic valve drives are often used in valves and in particular in vacuum valves, for example in order to drive the closure member for closing and/or releasing a valve opening of the valve. As compared to hydraulic valve drives, pneumatic valve drives in the case of a leakage or of a defect have the advantage that contaminations that are not as severe as would be the case in a spillage of the hydraulic oil or the like in hydraulic valve drives arise. For this reason, pneumatic valve drives are particularly preferred for valves in vacuum technology.

In the case of the prior art, pneumatic valve drives for a valve, in particular a vacuum valve, are conceived such that the pressure in both cylinder cavities is regulated. This is comparatively complex in terms of control technology.

SUMMARY

It is an object of the invention to provide a pneumatic valve drive of the type mentioned above which is of a more simple construction.

To this end, in the case of a valve drive as mentioned above, the invention proposes that one of the pressure sources is a constant pressure source for impinging the cylinder cavity that is disposed on one of the sides of the piston with a constant pressure, and another of the pressure sources is a regulated pressure source for impinging the cylinder cavity that is disposed on the opposite side of the piston with a variably regulatable pressure. In the context of this document, an artificial pressure source for impinging the respective cylinder cavity with pressure is referred to as a pressure source.

In simple terms, it is thus a fundamental concept of the invention that the pressure is regulated only in one of the cylinder cavities, while the cylinder cavity of the pneumatic cylinder that in relation to the piston lies opposite to the former is impinged with a constant pressure. If, by means of the regulated pressure source, the pressure in the cylinder cavity on the one side of the piston is set so as to be so high that the forces acting on the piston as a result thereof are larger than the forces that in the opposite cylinder cavity act on the piston by virtue of the constant pressure prevalent therein, the piston is thus moved in the one direction relative to the pneumatic cylinder. However, if the regulated pressure source regulates the pressure in the cylinder cavity that is connected to said regulated pressure source such that the forces that act on the piston are lower than the forces that in the other cylinder cavity act on the piston by virtue of constant pressure, the piston is thus moved in the other direction relative to the pneumatic cylinder. Due to a respective pressure level which is built up by the regulated pressure source in one of the cylinder cavities, the forces that act from both sides on the piston can also cancel one another such that the piston is fixed in the position thereof relative to the pneumatic cylinder. It is thus possible for both directions of movement of the piston relative to the pneumatic cylinder as well as for the standstill to be implemented by way of only one regulated pressure source. It is important to note herein that the pneumatic cylinder can be fixed in the position thereof while the piston is moved in the case of the relative movement mentioned. Conversely, it is just as possible for the piston to be fixed in the position thereof, while the pneumatic cylinder is moved relative to the piston. Both are possible in the case of the pneumatic valve drive according to the invention. On account of the relative movement of the piston in and in relation to the pneumatic cylinder, the volume in the one cylinder cavity in any case is always increased to the extent of said volume being reduced in the opposite cylinder cavity, and vice versa.

The fact that a pneumatic valve drive is presently referred to also means that both cylinder cavities are impinged, preferably exclusively, with a gaseous pressure medium. For example, compressed air, or else another suitable gaseous medium, can be used as the pressure medium.

In preferred design embodiments, the constant pressure source is designed so as to be as simple as possible. Said constant pressure source is therefore preferably not regulatable and is provided and/or designed exclusively for impinging the cylinder cavity that is disposed on one of the sides of the piston with a constant pressure. For the sake of completeness, it is to be pointed out that, for example, on account of a sudden change in the pressure by means of the regulated pressure source in one of the cylinder cavities, a brief variation in pressure can also arise in the other cylinder cavity, that is to say that cylinder cavity that is connected to the constant pressure source. Said variation in pressure is however specifically not caused by the constant pressure source but rather by other influencing factors. The constant pressure source is provided for permanently impinging the cylinder cavity on one side of the piston with a constant pressure. The constant pressure in preferred design embodiments of the invention in any case is above the normal atmospheric and/or ambient pressure. The positive pressure that is provided by the constant pressure source for impinging the cylinder cavity that is disposed on one of the sides of the piston is preferably in a pressure range from 1 bar to 4 bar, particularly preferably from 2 bar to 4 bar.

In principle, various parameters can be utilized as input parameters for regulating the pressure in one of the cylinder cavities, that is to say as the regulating variable for the regulated pressure source. However, in preferred design embodiments of the invention the position of the piston relative to the pneumatic cylinder is utilized as the process variable for the regulated pressure source. In this context, preferred design embodiments of the invention provide that the pneumatic valve drive has a regulator having a position-determining arrangement for determining the position of the piston relative to the pneumatic cylinder, wherein the regulator regulates the regulated pressure source in a manner dependent on this position. All measuring systems known in the prior art for determining the position of an object are to be considered as the position-determining arrangement. These measuring systems can be, for example, non-contacting magnetic, electrical, electromagnetic, or light-sensitive encoders, while linear encoders are also possible, in order for only a few examples to be mentioned.

The position-determining arrangement favorably measures the position of that part that is being moved. As has been mentioned above, this can be the piston as well as the pneumatic cylinder. It is possible for the position to be measured directly or else indirectly. The position could thus also be determined indirectly, for example, by way of a gearbox. In particular when the position of the piston is to be measured relative to a locationally fixed pneumatic cylinder, instead of measuring directly the position of the piston, it is expedient for the position of a component that is fixedly connected to said piston, such as for example a piston rod that protrudes from the pneumatic cylinder, to be measured.

In preferred design embodiments of the invention the pneumatic drive has at least one system pressure input. This can be a compressed air line or the like, for example. Particularly preferred variants of pneumatic valve drives according to the invention make do with precisely one system pressure input. It is thus possible, for example, for the system pressure input to be connected by way of a pressure reducer to the cylinder cavity that is disposed on one of the sides of the piston, in order for the constant pressure source to be configured. It is likewise possible that the preferably same system pressure input for configuring the regulated pressure source is connected at least by way of a pressure regulator valve to the cylinder cavity that is disposed on the opposite side of the piston.

In the case of exemplary embodiments in which the constant pressure source is fixedly connected to one of the cylinder cavities, and in which the regulated pressure source is fixedly connected to the other of the cylinder cavities of the pneumatic cylinder, the pressure differential between the constant pressure prevailing from the constant pressure source and the minimum pressure that can be set at the regulated pressure source is available at maximum for the relative movement between the piston and the pneumatic cylinder in one direction. The difference between the maximum pressure that can be set by way of the regulated pressure source and the constant pressure of the constant pressure source is available at maximum for the relative movement in the opposite direction. If the same pressure differential is to be available in both directions, the constant pressure source can thus be chosen or designed, respectively, such that said constant pressure source makes available approximately half the maximum pressure of the regulatable pressure source.

In order for the maximum possible pressure differential between the constant pressure source and the maximum pressure of the regulated pressure source to be made available in both directions of movement, preferred design embodiments however provide that the pneumatic valve drive has at least one switching valve for swapping the pressure source that is connected to the respective cylinder cavity. Due to this, it becomes possible for a first of the two cylinder cavities to be connected to the constant pressure source in a first position of the switching valve. The second of the cylinder cavities is then connected to the regulated pressure source in this switching position of the switching valve. If the switching valve is switched to the other switching position, the second of the cylinder cavities is then connected to the constant pressure source, and the regulated pressure source impinges the first of the cylinder cavities.

For valves, in particular vacuum valves, in which the closure member or another part that is driven by the pneumatic valve drive has to be moved exclusively in a reciprocating manner along a straight line, it is often sufficient for the pneumatic valve drive to have a single pneumatic cylinder having a single piston that is mounted so as to be displaceable therein. However, pneumatic drives according to the invention can also have more than one pneumatic cylinder having pistons that are displaceable therein, for example when a closure member of the valve is to be moved in a reciprocating manner along two mutually angled straight lines such as is the case, for example, in the so-called L-valve. Preferred design embodiments of pneumatic valve drives according to the invention can provide for such valves that the pneumatic valve drive has at least two pneumatic cylinders having in each case at least one piston that is mounted so as to be displaceable in the respective pneumatic cylinder, and having in each case at least two cylinder cavities that are disposed on mutually opposite sides of the respective piston, wherein each of the cylinder cavities is connected in each case to at least one pressure source in order for the respective cylinder cavity to be impinged with pressure, and in each case one of the pressure sources is a constant pressure source for impinging the cylinder cavity that is disposed on one of the sides of the piston with a constant pressure, and in each case another of the pressure sources is a regulated pressure source for impinging the cylinder cavity that is disposed on the opposite side of the piston with a variably regulatable pressure. At least one switching valve can also be provided in the case of such pneumatic valve drives, for example in order for the cylinder cavities of always only one of the pneumatic cylinders to be connected to the constant pressure source and to the regulated pressure source. This is expedient when, for example, as is the case in an L-valve, always only one of the pneumatic cylinders is operated at any given time. Additional switching valves for swapping the pressure source that is connected to the respective cylinder cavity can also be provided in such design embodiments.

As has already been indicated at the outset, the invention does however not only relate to a pneumatic valve drive but also to a valve having at least one pneumatic valve drive according to the invention. The valve is particularly preferably a so-called vacuum valve. These are valves which are used in vacuum technology. Vacuum technology is typically referred to when operating states having pressures of less than or equal to 0.001 mbar (millibar) are achieved. These are the operating pressures in the valve openings or in the vacuum chambers that are connected to the valve openings, respectively. Vacuum valves are valves which are conceived for these pressure ranges and/or respective pressure differentials in relation to the environment. However, vacuum valves can generally also be referred to when said vacuum valves are conceived for pressures below the normal pressure, that is to say below 1 bar.

In the case of preferred design embodiment of valves according to the invention it is provided that the pneumatic valve drive drives at least one closure member of the valve in order for a valve opening of the valve to be closed and/or released. The closure member here can be moved exclusively in a reciprocating linear manner along a straight line. However, said closure member can just as well be moved in a reciprocating manner along two mutually angled, preferably orthogonal, straight lines between the closure position and the release position.

In addition to the pneumatic valve drive and to the valve, the invention also relates to a method for operating a pneumatic valve drive according to the invention and/or a valve according to the invention. In the case of such methods according to the invention it is provided that the cylinder cavity that is disposed on one of the sides of the piston is impinged with the constant pressure by the constant pressure source, and the cylinder cavity that is disposed on the opposite side of the piston is preferably simultaneously impinged with the variably regulatable pressure by the regulated pressure source.

In other words, it is thus provided in the case of methods according to the invention that the pressure is kept constant in a cylinder cavity that is disposed on one side of the piston, while the pressure is preferably simultaneously regulated by the regulated pressure source on the other side of the piston in the cylinder cavity that is disposed there. In other words, the method according to the invention thus provides that the pressure is not regulated on both sides of the piston in the respective cylinder cavity.

Preferred design embodiments of the method according to the invention provide that the position of the piston relative to the pneumatic cylinder is determined by the position-determining arrangement, and the regulated pressure source is regulated by the regulator in a manner dependent on the position thus determined. The features that have been mentioned above in the context of the pneumatic valve drive according to the invention can otherwise also be applied to the method, in as far as possible and expedient. It applies here again in particular that the modification of the relative position between the pneumatic cylinder and the piston can be initiated by a movement of the piston as well as of the pneumatic cylinder as well as of both these parts.

BRIEF DESCRIPTION OF THE DRAWINGS

Further features and details of valve drives and valves according to the invention will be explained hereunder in an exemplary manner by the description of the figures in which.

DETAILED DESCRIPTION OF THE PREFERRED EMBODIMENTS

Figure 3:
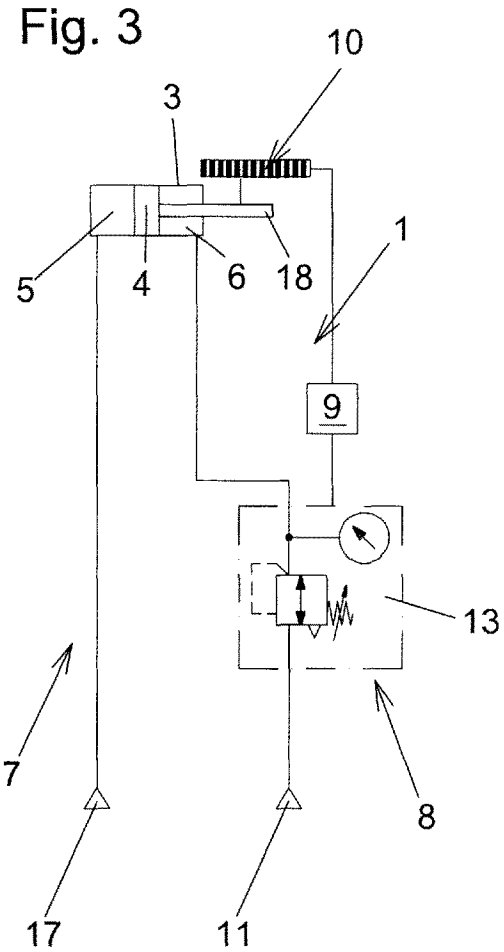
FIGS. 1 to 3 show different variants of pneumatic valve drives according to the invention, having only one pneumatic cylinder.
Figure 2:
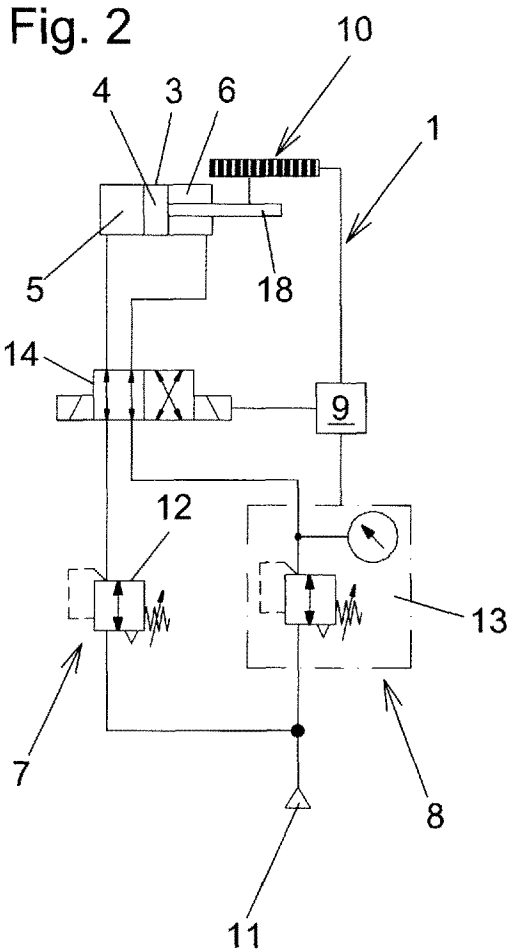
Figure 1:
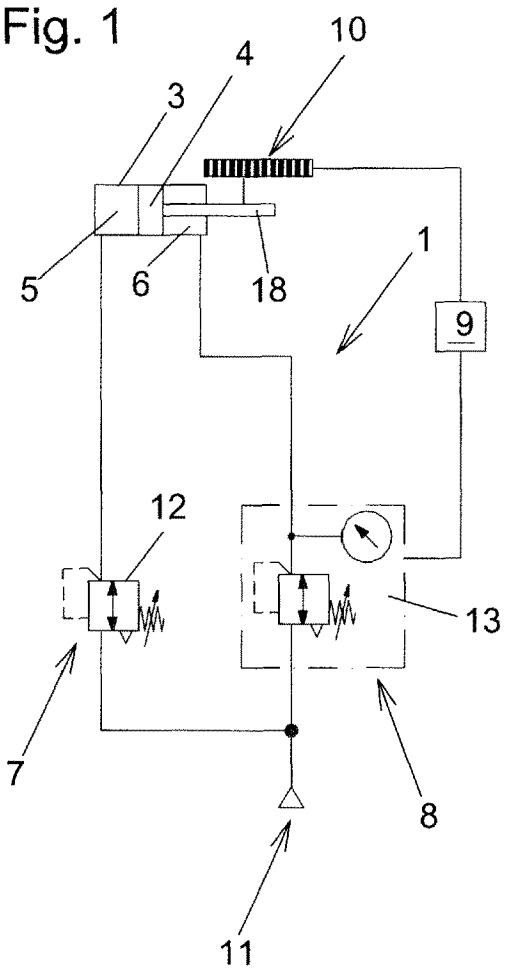
Figure 6:
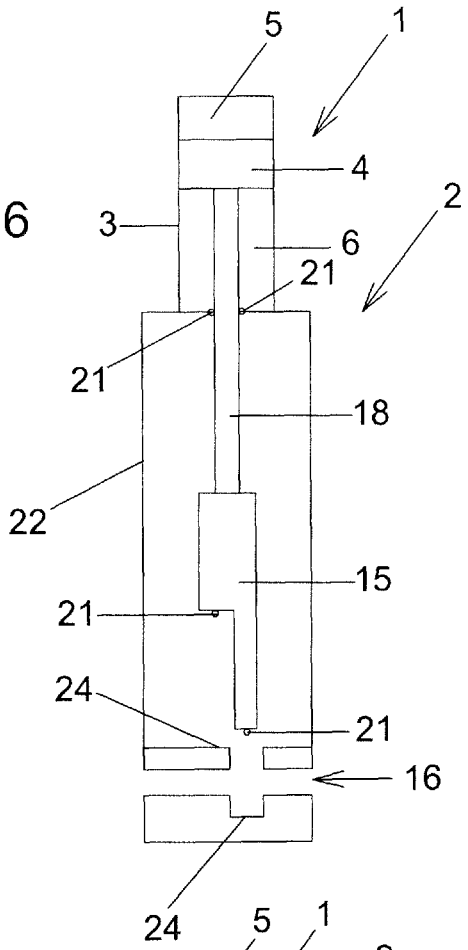
FIGS. 6 to 8 in a heavily schematic illustration show different valves according to the invention in which pneumatic valve drives according to the invention can be used.
Figure 7:
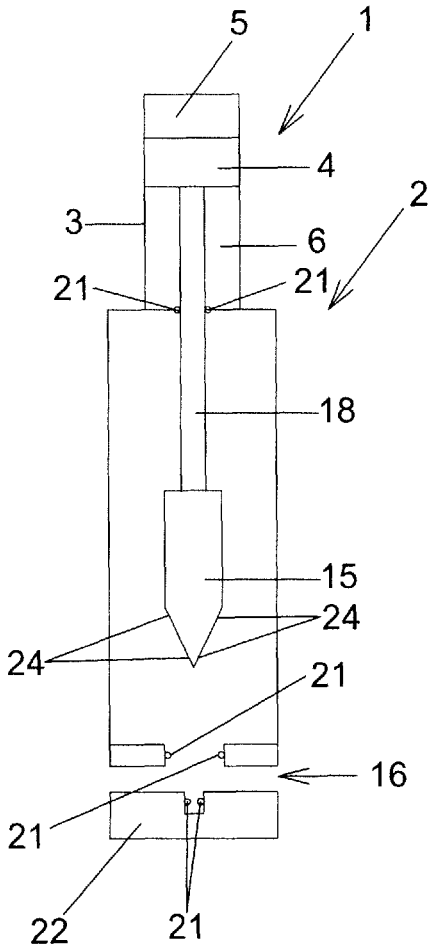

FIGS. 1 to 3 show different exemplary embodiments in which the pneumatic valve drive 1 according to the invention has only a single piston-cylinder unit in the form of the pneumatic cylinder 3, having the piston 4 that is mounted so as to be displaceable in the latter. Such pneumatic valve drives can be used, for example, when a closure member 15 has to be moved in a reciprocating linear manner only along a straight line or parallel with the latter, so as to close and release a valve opening 16 as is the case in the valves according to FIGS. 6 and 7, illustrated in a heavily schematic manner.

The exemplary embodiment according to FIG. 1 will be described first. The points of differentiation between the exemplary embodiments according to FIGS. 2 and 3 and the exemplary embodiment according to FIG. 1 will be explained subsequently. Apart from the points of differentiation that will be explained later, the description of the exemplary embodiment according to FIG. 1 can also be applied to the variants of embodiment according to FIGS. 2 and 3.

It can be readily seen in FIG. 1 that the piston 4 is located between two cylinder cavities 5 a 6 of the pneumatic cylinder 3. The cylinder cavity 5 is impinged with a constant pressure by the constant pressure source 7, while the cylinder cavity 6 that is disposed on the opposite side of the piston 4 is impinged with a variably regulatable pressure by way of the regulated pressure source 8. The constant pressure source 7 in the case of this variant of embodiment is formed by the interaction of the system pressure input 11 and the pressure reducer 12. The constant pressure that is made available by the constant pressure source 7 is favorably smaller than the system pressure of the system pressure input 11. The regulatable pressure source 8 is formed by the interaction of the same system pressure input 11 with the pressure regulator valve 13. The regulator 9 is provided for regulating the pressure regulator valve 13. The position of the piston 4 relative to the pneumatic cylinder 3 is determined by the position-determining arrangement 10. The regulator 9 regulates the regulated pressure source 8 and thus the pressure in the cylinder cavity 6 in a manner dependent on the position that is determined by the position-determining arrangement 10. In the exemplary embodiment shown the position of the piston 4 is determined indirectly by way of the position of the piston rod 18. Depending on the position of the piston 4 in the pneumatic cylinder 3 as measured by the position-determining arrangement 10, the regulated pressure source 8 regulates the pressure in the cylinder cavity 6 in such a manner that the piston 8 in the presently fixedly disposed pneumatic cylinder 3 is either moved in the desired direction or is retained in its position. The counter pressure that is applied in the cylinder cavity 5 by the constant pressure source 7 herein always acts as the counter pressure on the piston 4. If the piston 4 is to be moved such that the volume of the cylinder cavity 5 is reduced and the volume of the cylinder cavity 6 is enlarged, a corresponding positive pressure has to be generated in the cylinder cavity 6 by the regulated pressure source 8. For a movement in the opposite direction, in which the volume in the cylinder cavity 5 is enlarged and the volume in the cylinder cavity 6 is reduced, the pressure in the cylinder cavity 6 by the regulated pressure source 8 is regulated to a level which is correspondingly smaller than the constant pressure in the cylinder cavity 5. In order for the piston 4 and thus also for the piston rod 18 to be fixedly held in a position, the pressure in the cylinder cavity 6 is regulated such that the forces 4 acting on the piston cancel one another. The acceleration and deceleration procedures in the displacement of the piston 4 relative to the pneumatic cylinder 3 can be regulated in a corresponding manner by way of the regulation depending on the relative position between the piston 4 and the pneumatic cylinder 3 as described, in that in each case a respective pressure is applied in the cylinder cavity 6.

In the case of the variant of embodiment according to FIG. 1, the maximum pressure differential that is available for the movement of the piston 4 in one direction is established by the difference between the maximum pressure that can be applied in the cylinder cavity 6 and the constant pressure in the cylinder cavity 5. The maximum possible pressure differential for moving the piston in the opposite direction is predefined by the difference between the constant pressure that prevails in the cylinder cavity 5 and the minimal pressure that can be applied in the cylinder cavity 6. In order for comparable pressure differentials to be available in both directions in the case of this variant, the constant pressure must thus be set by the constant pressure source 7 such that said constant pressure corresponds approximately to half the maximum pressure that can be set by means of the regulatable pressure source 8, wherein adaptations in terms of the different surfaces on the piston 4 that result from the piston rod 18 are to be considered in each case.

A switching valve 14 that is likewise actuated by the regulator 9 and by way of which the pressure source that is connected to the respective cylinder cavity 5 and 6 can be swapped is provided in the embodiment of the invention in FIG. 2. In the switching position of the switching valve 14 shown in FIG. 2, the cylinder cavity 5 is thus impinged with a constant pressure by the constant pressure source 7, while the cylinder cavity 6 is impingeable with a variably regulatable pressure by the regulated pressure source 8. However, if the switching valve 14 is switched to the other switching position, the regulatable pressure source 8 impinges the cylinder cavity 5 with a variably regulatable pressure while the cylinder cavity 6 is impinged with constant pressure by the constant pressure source 7. Due to this, it is possible for the maximum pressure differential that is in each case possible between the regulated pressure of the regulated pressure source 8 and the constant pressure of the constant pressure source 7 to be made available to both directions of movement of the piston 4 relative to the pneumatic cylinder 3. The switching position which the switching valve 14 assumes in the variant according to FIG. 2 is regulated by the regulator 9 preferably likewise in a manner dependent on the position of the piston 4 relative to the pneumatic cylinder 3.

A variant of the invention in which the constant pressure source 7 and the regulated pressure source 8 are not supplied with system pressure by a single system pressure input 11 is now shown in FIG. 3. The constant pressure source 7 in the variant according to FIG. 3 has a dedicated second system pressure input 17. Deviating from the exemplary embodiment shown here, a pressure reducer 12 as in the first two exemplary embodiments can also be provided between this second system pressure input 17 and the cylinder cavity 5. However, if the constant pressure that is made available by the system pressure input 17 corresponds to the desired pressure level, the pressure reducer 12 can be dispensed with. The pressure regulator valve 13 of the regulated pressure source 8 in this exemplary embodiment is connected to the system pressure input 11. The constant pressure that is made available by the system pressure input 17 is favorably lower than the system pressure that is made available by the system pressure input 11. This variant according to FIG. 3 otherwise corresponds to the variant according to FIG. 1.

Figure 4:
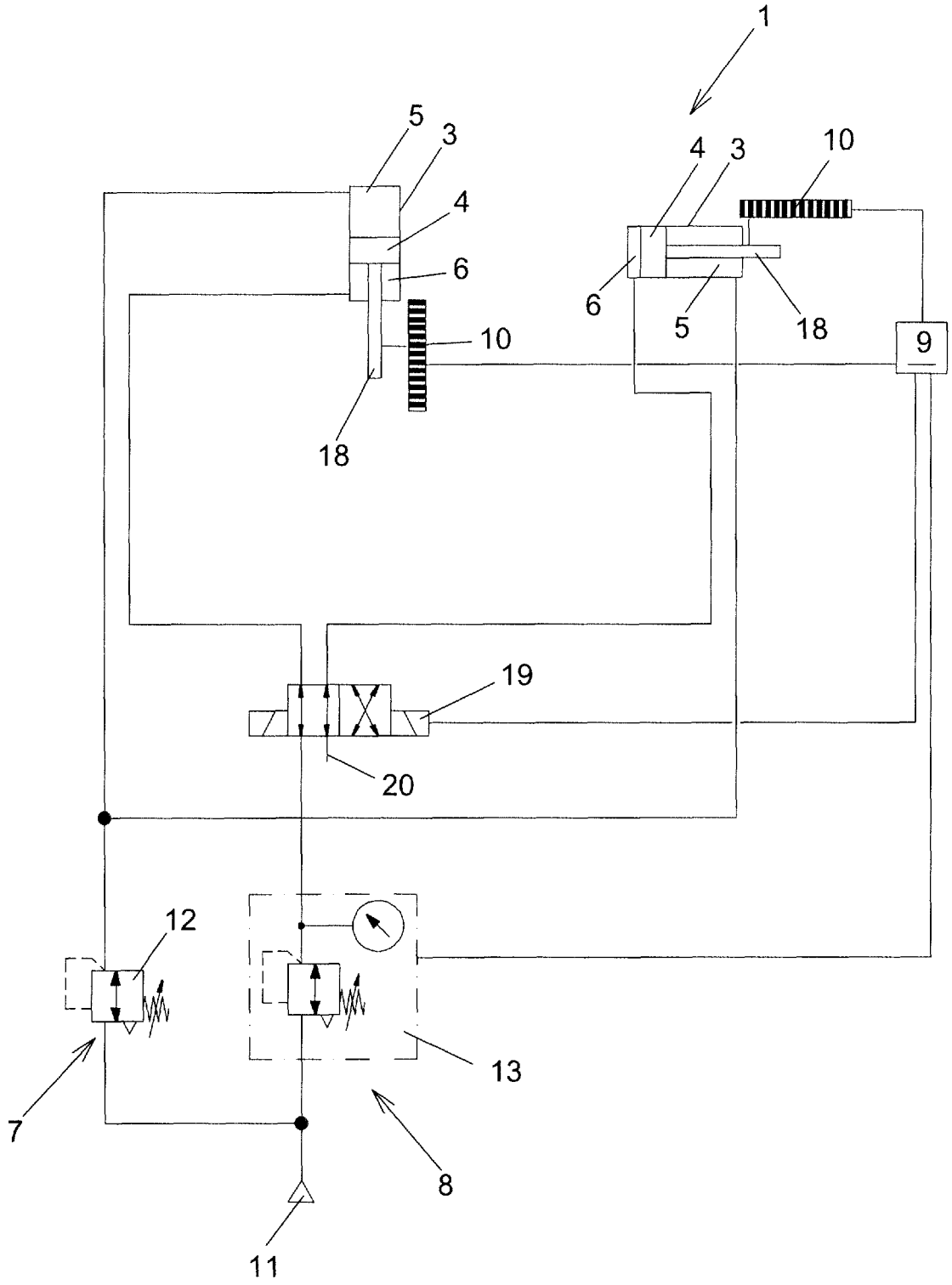
FIGS. 4 and 5 show variants of pneumatic valve drives according to the invention, having in each case two pneumatic cylinders.

A pneumatic valve drive 1 which has two pneumatic cylinders 3 having in each case a piston 4 that is mounted so as to be displaceable therein is now shown in FIG. 4. Piston rods 18, of which the position is determined by the respective position-determining arrangement 10, are again respectively located on the pistons, such that the position of the piston 4 relative to the pneumatic cylinder 3 is also determined in each case. The constant pressure source 7 impinges the cylinder cavities 5 of the pneumatic cylinders 3 in each case with a constant pressure. A variably adjustable pressure can be applied to the respective cylinder cavities 6 by way of the regulated pressure source 8. The respective piston 4 is moved or retained in its position in the respective pneumatic cylinder 3 by way of the resulting force that is generated from the pressure and the counter pressure in the cylinder cavities 5 and 6. This functions in the same manner as in the first exemplary embodiment according to FIG. 1 and therefore does not need to be explained once again. The constant pressure source 7 and the regulated pressure source 8 are also constructed as in the first exemplary embodiment according to FIG. 1 and therefore also do not have to be described in more detail.

Figure 8:
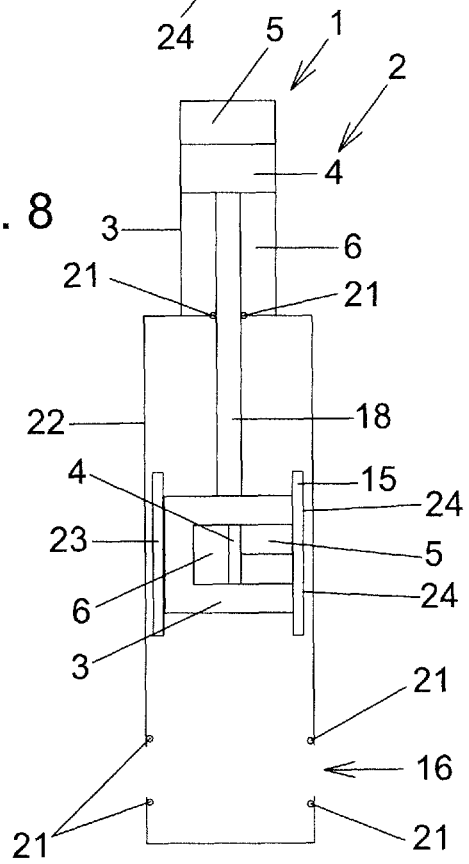

An additional switching valve 19 is provided in order for the pneumatic cylinders 3 in the exemplary embodiment according to FIG. 4 to be able to be individually actuated. This switching valve 19 in the one switching position connects the cylinder cavity 6 of one pneumatic cylinder 3 to the regulated pressure source 8, and in the other switching position connects the cylinder cavity 6 of the other pneumatic cylinder 3. That cylinder cavity 6 which in the respective switching position of the switching valve 19 is currently not connected to the regulated pressure source 8 is in this switching position connected to the gas outlet 20 which is under atmospheric or ambient pressure, respectively. Due to this, the respective piston 4 of that pneumatic cylinder 3, of which the cylinder cavity 6 is currently connected to the gas outlet 20 in this switching position, is held in a terminal position by the constant pressure in the cylinder cavity 5. Thus, only one of the pistons 4 can be moved by the pneumatic cylinder 3 at any given time, this corresponding to the requirements for moving a closure member 15 in a so-called L-valve that is schematically illustrated in FIG. 8. The pneumatic valve drive 1 shown in FIG. 4 is thus particularly suitable for driving the closure member 15 of so-called L-valves. Regulating the regulated pressure source 8 and the switching valve 19 in the exemplary embodiment according to FIG. 4 is performed by way of the regulator 9 in a manner dependent on the relative position between the piston 4 and the pneumatic cylinders 3 as determined by means of the position-determining arrangement 10.

In the exemplary embodiment according to FIG. 4 it is provided that the pneumatic cylinders 3 are fastened in a locationally fixed manner and that the pistons 4 move relative to said pneumatic cylinders 3. As has been explained at the outset and is also the case in other exemplary embodiments, this can of course also be provided so as to be reversed. Thus, the piston 4 can just as well be fixed in the position thereof, and the respective pneumatic cylinder 3 can be moved relative to said piston 4. In this case, it is then expedient for the position of the pneumatic cylinder 3 to be determined by way of the position-determining arrangement 10.

Figure 5:
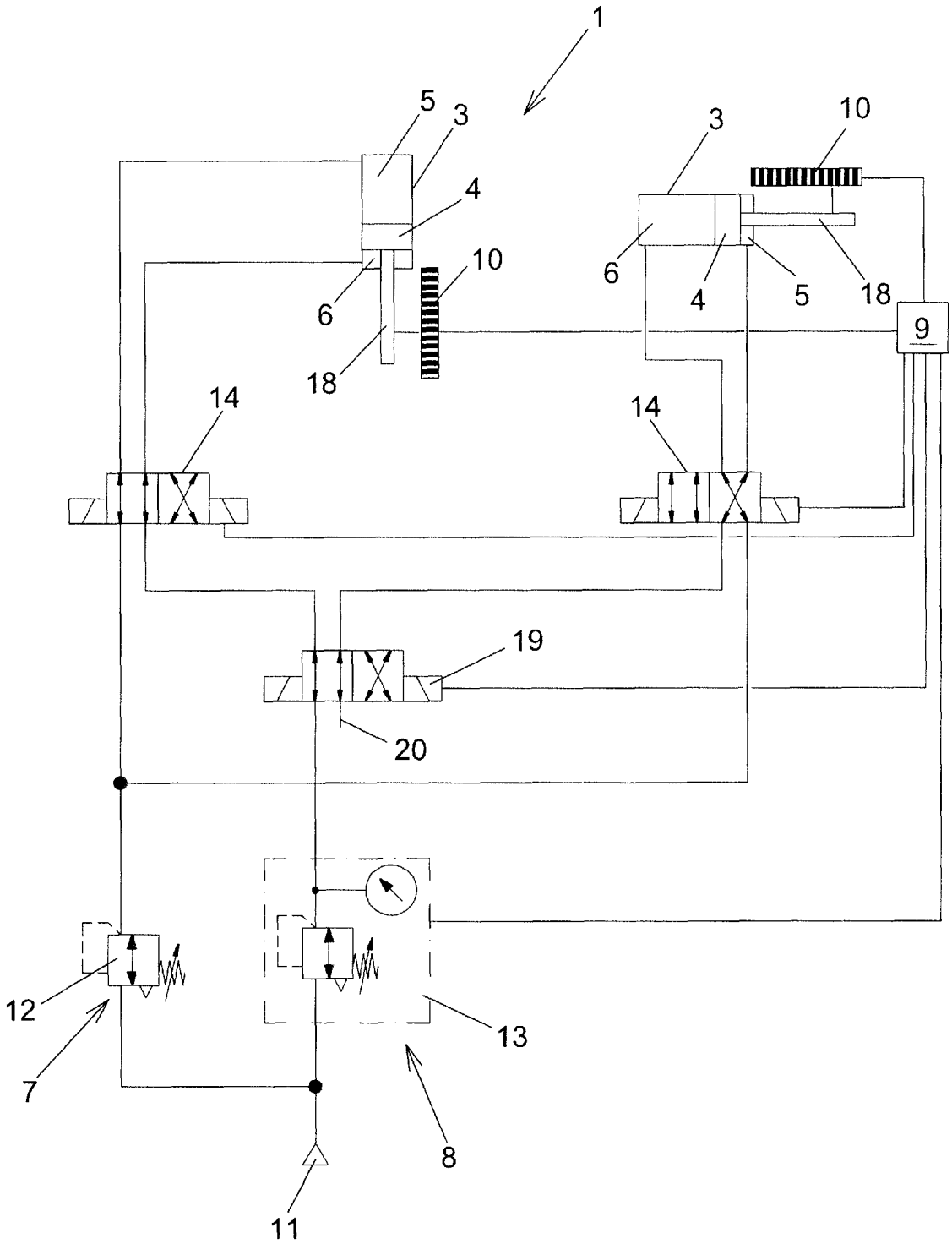

The exemplary embodiment according to FIG. 5 is a combination of the exemplary embodiments according to FIGS. 4 and 2. In addition to the switching valve 19, switching valves 14 which are likewise actuated by the regulator 9 are additionally present in FIG. 5 in the supply lines to the cylinder cavities 5 and 6 of each pneumatic cylinder 3, these switching valves 14 serving the purpose that has already been described in the context of FIG. 2 that the respective piston 4 can be moved in both directions of movement at the maximum possible pressure differential between the constant pressure of the constant pressure source 7 and the maximum possible pressure of the regulated pressure source 8.

Heavily schematic valves 2 in the form of vacuum valves are now shown in FIGS. 6 to 8, in which valves 2 the pneumatic valve drives 1 according to the invention and according to FIGS. 1 to 5 can be used. The pneumatic valve drives 1 in the exemplary embodiments shown are used in the valves 2 according to the invention in order for the respective closure member 15 to move in a reciprocal manner between the closed position thereof, in which said closure member 15 closes the valve opening 16, and the release position thereof, in which said closure member 15 releases the valve opening 16. To this end, only the reciprocal movement along only a straight line is required in the exemplary embodiments according to FIGS. 6 and 7. Accordingly, the pneumatic valve drives 1 according to the invention and according to FIGS. 1 to 3 can be used in FIGS. 6 and 7. The release position in which the valve opening 16 is opened is in each case drawn in FIGS. 6 and 7. The closure member 15 is in each case in the maximum retracted release position. In order for the valve opening 16 to be completely closed, the closure member 15 in FIG. 6 is driven downward by the pneumatic valve drive 1 so far that the seals 21 are urged in a sealing manner against the valve seats 24. The wedge-shaped closure member 15 in FIG. 7 is moved downward by the pneumatic valve drive 1 so far that the seals 21 come to bear on the valve seats 24.

FIG. 8 in a heavily schematic manner shows a valve 2 in the form of a so-called L-valve. The plate-shaped closure member 15 moved here by two pneumatic valve drives 1 in a reciprocating manner between the closing position thereof, an intermediate position, and the release position shown in FIG. 8. The closure member 15 in the directions that are parallel with the vertical is moved by the pneumatic valve drive 1 that sits on top of the valve housing 22 between the release position illustrated in FIG. 8 and an intermediate position in which the closure member 15 already covers the valve opening 16 but is not yet urged against the seal 21. Urging the closure member 15 by way of the valve seats 24 thereof in the horizontal direction onto the seals 21 is performed by the other pneumatic cylinder 3 which is located and acts between the closure member 15 and a support plate 23. As is known, the support plate 23 serves as a counter support when the closure member 15 by way of the valve seats 24 thereof is urged onto the seals 21. The valve drives 1 according to FIGS. 5 and 6 can be used the case of such an L-valve that is schematically illustrated in the figures.

In general, only the pneumatic cylinders 3, the pistons 4, the cylinder cavities 5 and 6, and the piston rods 18 of the valve drives 1 are illustrated in FIGS. 6 to 8. The remaining components of the pneumatic valve drives 1 are not illustrated in FIGS. 6 to 8. However, as has been mentioned, said remaining components can be embodied as is shown in FIGS. 1 to 5.

LIST OF REFERENCE SIGNS

1 Pneumatic valve drive
2 Valve
3 Pneumatic cylinder
4 Piston
5 Cylinder cavity
6 Cylinder cavity
7 Constant pressure source
8 Regulated pressure source
9 Regulator
10 Position-determining arrangement
11 System pressure input
12 Pressure reducer
13 Pressure regulator valve
14 Switching valve
15 Closure member
16 Valve opening
17 Second system pressure input
18 Piston rod
19 Switching valve
20 Gas outlet
21 Seal
22 Valve housing
23 Support plate
24 Valve seat

The invention claimed is:

1. A pneumatic valve drive for a valve, comprising a pneumatic cylinder;

at least one piston that is mounted so as to be displaceable in the pneumatic cylinder;

at least two cylinder cavities of the pneumatic cylinder are disposed at mutually opposite sides of the piston, each of the cylinder cavities is connected in each case to at least one pressure source in order for the respective cylinder cavity to be impinged with pressure, one of the pressure sources is a constant pressure source for impinging the cylinder cavity that is disposed on one of the sides of the piston with a constant pressure, and another of the pressure sources is a regulated pressure source for impinging the cylinder cavity that is disposed on an opposite side of the piston with a variably regulatable pressure;

a regulator having a position-determining arrangement for determining a position of the piston relative to the pneumatic cylinder, and the regulator regulates the regulated pressure source in a variable manner between a maximum pressure differential with the constant pressure for moving the piston in one direction, a minimal pressure for movement of the piston in an opposite direction, and a pressure equal to the constant pressure to fixedly hold the piston in said position; and at least one switching valve for swapping the pressure source that is connected to the respective cylinder cavity.

2. The pneumatic valve drive as claimed in claim 1, further comprising at least one system pressure input.

3. The pneumatic valve drive as claimed in claim 2, wherein the system pressure input is connected by way of a pressure reducer to the cylinder cavity that is disposed on one of the sides of the piston in order for the constant pressure source to be configured, or the system pressure input for configuring the regulated pressure source is connected at least by way of a pressure regulator valve to the cylinder cavity that is disposed on the opposite side of the piston.

4. The pneumatic valve drive as claimed in claim 2, wherein the system pressure input is connected by way of a pressure reducer to the cylinder cavity that is disposed on one of the sides of the piston in order for the constant pressure source to be configured, and the system pressure input for configuring the regulated pressure source is connected at least by way of a pressure regulator valve to the cylinder cavity that is disposed on the opposite side of the piston.

5. The pneumatic valve drive as claimed in claim 1, further comprising a second pneumatic cylinder having at least one piston that is mounted so as to be displaceable in the second pneumatic cylinder, and having at least two cylinder cavities in the second pneumatic cylinder that are disposed on mutually opposite sides of piston, wherein each of the cylinder cavities is connected to the at least one pressure source in order for the respective cylinder cavity to be impinged with pressure, and in each case one of the pressure sources is the constant pressure source for impinging the cylinder cavity that is disposed on one of the sides of the piston in the second pneumatic cylinder with a constant pressure, and in each case another of the pressure sources is the regulated pressure source for impinging the cylinder cavity that is disposed on the opposite side of the piston in the second pneumatic cylinder with a variably regulatable pressure.

6. The valve having at least one pneumatic valve drive as claimed in claim 1.

7. The valve as claimed in claim 6, further comprising at least one closure member, and the pneumatic valve drive drives the at least one closure member in order for a valve opening of the valve to be at least one of closed or released.

8. A method for operating a pneumatic valve drive as claimed in claim 1, comprising impinging the cylinder cavity that is disposed on one of the sides of the piston with the constant pressure by the constant pressure source, and impinging the cylinder cavity that is disposed on the opposite side of the piston with the variably regulatable pressure by the regulated pressure source.

9. The method as claimed in claim 8, further comprising determining a position of the piston relative to the pneumatic cylinder by a position-determining arrangement, and regulating the regulated pressure source by a regulator in a manner dependent on the position thus determined.

* * * * *